United States Patent [19]

Vits

[11] 4,222,697

[45] Sep. 16, 1980

[54] DEVICE FOR REMOVING A STACK OF SHEETS OF PAPER

[75] Inventor: Hilmar Vits, Leichlingen, Fed. Rep. of Germany

[73] Assignee: VITS-Maschinenbau GmbH, Langenfeld, Fed. Rep. of Germany

[21] Appl. No.: 960,483

[22] Filed: Nov. 13, 1978

[30] Foreign Application Priority Data

Nov. 18, 1977 [DE] Fed. Rep. of Germany ..... 2751489

[51] Int. Cl.[3] ..... B65G 57/03

[52] U.S. Cl. ..... 414/50; 271/218; 414/114

[58] Field of Search ..... 414/50, 114, 91; 271/218, 217, 189

[56] References Cited

U.S. PATENT DOCUMENTS

| | | | |
|---|---|---|---|
| 3,055,516 | 9/1962 | Mead | 414/114 |
| 3,211,301 | 10/1965 | Welhouse | 414/114 |
| 3,889,824 | 6/1975 | Wood | 414/50 X |

FOREIGN PATENT DOCUMENTS

| | | | |
|---|---|---|---|
| 731488 | 4/1966 | Canada | 271/218 |

*Primary Examiner*—Frank E. Werner
*Attorney, Agent, or Firm*—J. Harold Nissen

[57] ABSTRACT

Device for removing a stack of sheets of paper from a place of deposit to which the sheets are conveyed by a conveyor including a platform and a carrier unit. The conveyor can be lowered in relation to the plane in which the sheets are conveyed as the height of the stack increases for receiving the stack. The carrier unit can be inserted above the platform in the area of the place of deposit and on which the sheets conveyed further to the place of deposit are stacked while the platform loaded with the stack is exchanged for an empty platform. The carrier unit is composed of two plates which are arranged directly one above the other and which are capable of being inserted independently of one another into the upper area of the stack. The upper plate is triangularly shaped at its front end and has one tip pointing to the stack, and the lower plate is rectangularly shaped or straight at its front portion, whereby the surface of the upper plate, which is inserted into the stack end position, is about equal to half the surface of the stack of sheets.

6 Claims, 6 Drawing Figures

DEVICE FOR REMOVING A STACK OF SHEETS OF PAPER

BACKGROUND OF THE INVENTION

1. FIELD OF THE INVENTION

The invention relates to a device for removing a stack of sheets of paper from a place of deposit.

More particularly, the invention is concerned with a paper stack removal device to remove a stack of sheets from a place of deposit to which the sheets are conveyed by a conveying means and comprises a carrier unit and a platform. The platform can be lowered to receive the stack in relation to the plane, in which the sheets are conveyed as the height of the stack increases. The carrier unit can be inserted above the platform in the area at the place of deposit and the sheets on the platform can be conveyed further to the place of deposit where the sheets are stacked while the platform loaded with the stack is exchanged for an empty platform.

2. DESCRIPTION OF THE PRIOR ART

In a known device of this type, the carrier unit is in the form of a bar grate and is inserted in the flow of the sheets being deposited onto the stack. When those sheets which are still being conveyed are transported into the bar grate, the platform can be lowered further and replaced with an empty platform. The sheets which are collected in the meantime on the bar grate are deposited onto the new platform in a small pile when the bar grate withdraws. If disturbances are to be avoided, a high degree of skill is necessary to insert the bar grate into the stack of sheets when they are not as yet at a standstill on the stack.

Moreover, when the bar grate is being withdrawn, there is danger of at least the lower sheets corrugating and becoming damaged due to friction from the bar grate.

In another known device for removing a stack, a transport belt is arranged in the direction in which the sheets are conveyed to the place of deposit. This transport belt is stopped when the loaded platform is being replaced with a new platform and receives the sheets still being conveyed, so that a small pile is formed on the belt. When the empty platform is in its operating position, the transport belt is again started, and the small pile formed during the intermediary period is conveyed onto the platform. Tests with such a device have shown that it is only suitable for low sheet sequence speeds. It is further known to arrange a side way in front of the place of deposit, via which the perfect sheets which are still being conveyed while the platform loaded with the stack is being replaced by a new platform, are diverted off as spoiled sheets.

It is an object of the invention to provide a device for removing a stack of sheets of paper which can be inserted simply in the area of the place of deposit without disturbing the flow of the sheets and without damaging the sheets.

SUMMARY OF THE INVENTION

According to the invention, a device of the aforementioned type is provided in which the carrier unit is composed of two plates arranged directly one above the other. Each of the plates can be inserted independently of one another into the upper area of the stack. The upper plate is triangular at its front end and the apex of the triangle points to the stack with one point or the apex of the triangle, and the lower plate is rectangular at its front, so that the surface of the upper plate which is inserted up to its end position is about equal to half the surface of the stack of sheets.

A feature of the device according to the invention is that the flow of sheets to the place of deposit is not disturbed, since the plate is inserted with its triangular tip between those sheets which were previously deposited onto the platform and are already on the platform. Due to the tip, the plate is inserted without damaging the sheet and without the adjacent sheets shifting onto and relative to one another. The latter is effected by half the surface of the sheets lying one on top of the other retaining a fixed hold thereto when the plate is inserted. There is no difficulty in inserting the lower rectangular plate, which is rectangular at the front, after the stack carried by the platform has been divided by slightly lowering the small pile. This small pile is partly supported by the plate with the triangular tip, and the dividing of the pile forms a gap for insertion of the rectangular plate. While the sheets are being conveyed further, the new stack is supported on its entire surface by both plates. When a new empty platform has been raised to a position below the lower plate, the lower plate can be removed without the sheets corrugating, as in this case also, the power due to the inertia of the sheets, which are supported on half their surface by the plate with the triangular tip, is sufficiently great to prevent the sheets from slipping.

In accordance with one embodiment of the invention, the upper plate can be constructed in such a way that with the triangularly-shaped upper plate, the upper plate can be inserted with its tip up to the rear edge of the stack. The sides of the triangular tip then reach into corners of the front edge of the stack. According to another embodiment of the invention, which is suitable when maintaining the surface ratios with different lengths of sheet, the upper plate is constructed in such a way that when the upper plate is inserted with its tip up to the central area of the stack, the sides of the triangular tip end at the side edges of the stack.

The tip is preferably arranged in the center. For expedience, the plates are in the form of carriages or cradles and run or are supported on lateral rails.

Other objects, advantages and the nature of the invention will become readily apparent fron the detailed description of the invention described in connection with the accompanying drawings.

DETAILED DESCRIPTION OF THE PREFERRED EMBODIMENTS

Figure 1:
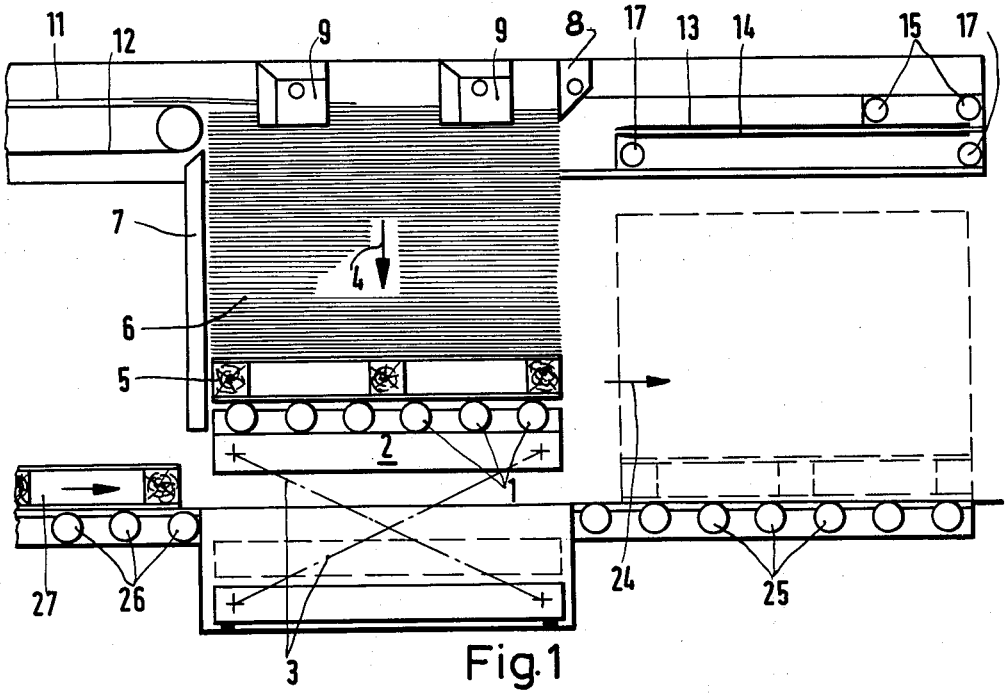
FIG. 1 is a schematic lateral view of a device according to the invention for removing a stack of sheets.
Figure 2:
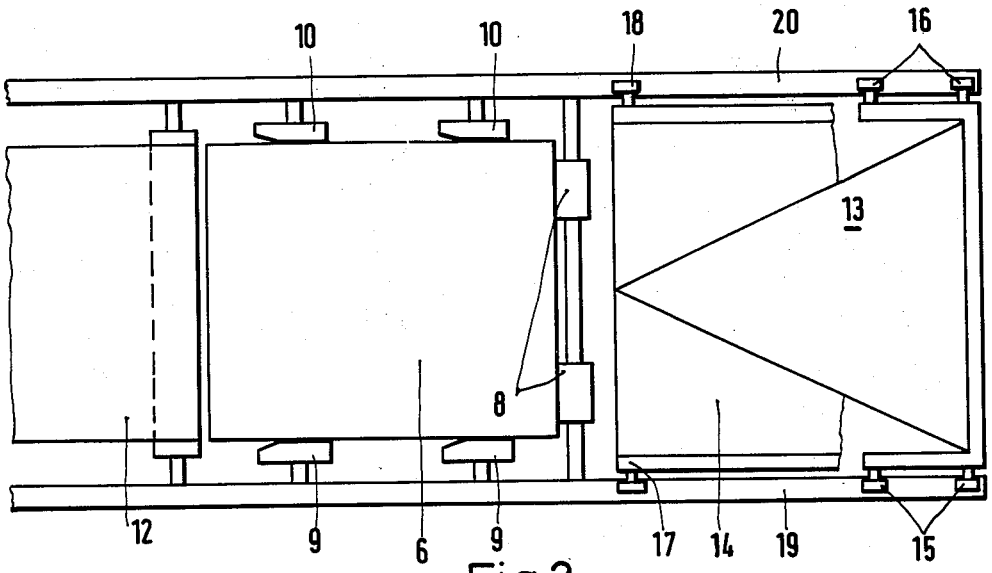
FIG. 2 is a top view of the device according to FIG. 1.
Figure 3:
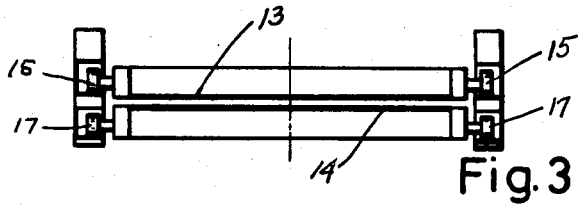
FIG. 3 is a view of the upper part of the device according to FIG. 1 as viewed from the front side thereof.

Referring to the drawings which illustrate the best mode for carrying out the invention, and in particular to FIGS. 1 and 2, there is shown the device for removing a stack of sheets which comprises a platform 2 having rollers 1. Platform 2 is carried by a scissor support 3 and can be lowered in the direction of arrow 4 by means of the scissor support 3. The rollers 1 form a roller table which bears a pallet 5, onto which a stack 6 of sheets with the same format is formed. A guide element 7 is arranged on the rear side of the stack in the form of a plate or of vertically extending, spaced gibs. Stops 8 are positioned in the upper area of stack 6 opposite guide element 7. Stack 6 is guided laterally in the direction of arrow 24 by guide lugs 9,10 which are arranged on each side and one behind the other on the same side in the direction of arrow 24. Each of the guide lugs has a vibratory drive. The sheets are thereby deposited while being conveyed with their edges straight without getting caught when conveyed. Sheets 11 are conducted to the place of deposit by a continuously moving transport belt 12. Sheets 11 are moved along a conveying plane to an upper plane of stack 6, and the upper plane of the stack 6 is held along the conveying plane by lowering the platform 2 which lowering is effected by means of the scissor support 3.

A carrier unit or cradle comprising two plates 13,14 is arranged on the side of the place of deposit opposite to the transport belt 12. Plates 13,14 are arranged one directly above the other and can be moved independently of each other. Plates 13, 14 are run on lateral rails 19, 20 by means of rollers 15, 16, 17, 18.

In the embodiment according to FIG. 2, upper plate 13 has the form of an isosceles triangle. The tip or apex of triangular plate 13 is arranged in the center of plate 14, and the sides of which extend from the apex and terminate in the corners of rectangular plate 14 which is positioned below it.

Figure 4:
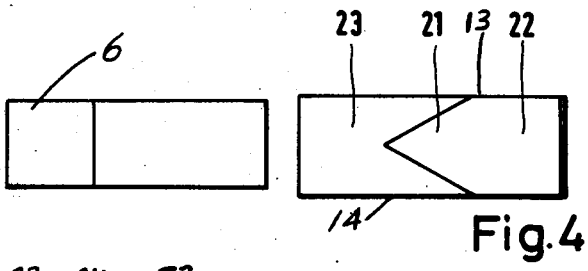
FIG. 4 is a partial schematic top view of the place of deposit with sheets of short length, prior to the plates being inserted.

As will be noted, in FIG. 4, the plates 13 and 14 are shown in their position just prior to being inserted, the plate 13 includes a triangular tip 21 and a square or rectangular (quadrilaterally-shaped) rear part 22. Plate 14 includes a rectangular or quadrilaterally-shaped member 23 having a straight front edge transverse to the direction of movement of plate 24 into the stack 6. The overall length of the upper plate 13 is greater than the overall length of the lower plate 14.

Figure 5:
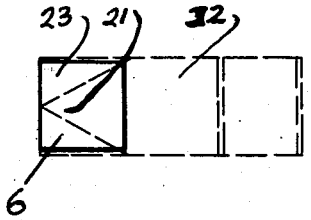
FIG. 5. is a partial schematic top view of the place of deposit according to FIG. 4, but showing the position after the plates have been inserted; and, FIG. 6 is a partial schematic top view of the place of deposit according to FIG. 4, with sheets of a greater length, after the plates have been inserted.

According to FIG. 5, the plates 13, 14 of FIG. 4 are shown in dashed outline form and in a position after being inserted. In this position, the tip 21 extends to the rear edge of the paper in stack 6, in order to fulfill the requirement that even using plates 13, 14 which are longer than the stack 6 of sheets half the surface of the stack 6 being supported by the upper plate 13.

Figure 6:
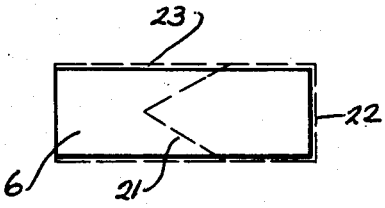

In FIG. 6, the plates 13, 14 have the same shape as those of FIGS. 4 and 5 and are shown in dashed outline form, whereas the stack 6 has about the same length as the lower plate 23 and is shown in uninterrupted lines. In order to fulfill the requirement that half the surface of stack 6 is supported by the rectangular plate 23 and the plate 22 with the triangular tip 21 in each case when the plates have been inserted, the triangular tip 21 ony reaches to the central area of the stack 6.

Referring again to FIGS. 1 and 2, a roller table 25 is provided behind stack 6 in order to move pallet 5 loaded with a stack 6 from off the platform 2 in the direction of arrow 24. A corresponding roller table 26 is positioned on the opposite side to the rear of guide element 7. An empty pallet 27 can be run over roller table 26 onto roller table 1 of empty platform 2.

As shown in FIG. 1, the front edges of the plates 13, 14 are necessarily constructed in the form of cutting edges in order to facilitate their insertion into stack 6. The front of plate 14 is a straight edge which forms one side of the rectangular configurated plate.

OPERATION OF THE DEVICE

Removal of stack 6 is achieved in the following manner:

During a continuous running of the sheets to the place of deposit, upper plate 13 is inserted with or by means of the triangular tip into the upper area, i.e. into an area at which the sheets are already at a standstill and where the sheets also lie one on top of the other with about half their surface until the insertion of the plates 13,14 is finished; the power of inertia of the plates is sufficiently great to prevent them from being shifted by the inserted upper plate 13.

Then, when the upper plate 13 has reached the desired end position, platform 2 is lowered only slightly so as to enable or facilitate the insertion of lower plate 14. During this insertion, upper plate 13 for all practical purposes carries the upper small stack alone. The surfaces of the aforesaid small stack which are not supported are still carried by the slightly lowered stack. After lower plate 14 has been inserted, the upper small stack is carried completely by the two plates 13, 14 so that platform 2 can be lowered further down to the level of roller tables 25, 26.

Pallet 5 with the lowered stack 6 is then shifted onto roller table 25 in the direction of arrow 24, and a new pallet 27 is run fron the roller table 26 onto roller table 1 of platform 2.

Platform 2 then raises pallet 27 which has been placed thereon until it is at a short distance below lower plate 14.

Plate 14 can then be returned. The unsupported free surfaces of stack 6, which has increased during the intermediary period, are then carried by pallet 27.

Platform 2 can then be further raised slightly so that the areas of stack 6 which are not supported can rest more on pallet 27. Upper triangular plate 13 can then also be returned.

The sheets do not shift thereby since the power of inertia of the sheets is greater on the rough surface of the pallet 27 than on the smooth surface of the plate 13.

While there has been shown and described what is considered to be the preferred embodiments of the invention, it will be obvious to those skilled in the art that various changes and modifications may be made therein without departing from the scope of the invention.

I claim:

1. In a device for removing a stack of sheets of paper from a place of deposit to which the sheets are conveyed by a conveying means, said device comprising a platform for receiving the stack, means associated with said platform for the lowering thereof, in relation to a plane in which the sheets are conveyed onto the stack as the height of the stack increases, and a carrier unit insertable above the platform in the area of the place of deposit and onto which the sheets conveyed further to the place of deposit are stacked while the platform loaded with the stack is removed and replaced with an empty platform, the improvement comprising;

said carrier unit being composed of two plates arranged directly one above the other and each being insertable independently of one another into an upper area of the stack, said upper plate having a triangular shape at a front end with the apex thereof at its front forming a triangular tip pointing towards the stack, and said lower plate having a straight configuration at a front end, the surface portion of said upper plate being inserted into the stack up to an end position, said surface portion being approximately equal to half a surface portion of the stack of sheets.

2. Device according to claim 1, wherein the sides of said triangular tip reach into the corners of the front edge of the stack when said upper plate is inserted with said tip up to a rear edge of the stack.

3. Device according to claim 1, wherein, the upper plate, which is inserted with its tip up to a central area of the stack, the sides of said triangular tip end being at the side edges of the stack when said upper plate is inserted with its said tip up to the center of the stack.

4. Device according to claim 1, 2 or 3, wherein said plates are constructed as carriages which run on lateral rails.

5. Device according to claim 1, 2, or 3, wherein said tip of the triangle is in the center of said upper plate.

6. Device according to claim 1, wherein the plates are constructed as cradles which are supported on lateral rails, and said tip of said triangle is arranged in the center of said upper plate.

* * * * *